United States Patent [19]

Hackmann

[11] Patent Number: 4,715,496

[45] Date of Patent: Dec. 29, 1987

[54] SHOE POLISH CAN

[75] Inventor: Ludger Hackmann, Lohne/Oldenburg, Fed. Rep. of Germany

[73] Assignee: Bramlage Gesellschaft mit beschränkter Haftung, Lohne/Oldenburg, Fed. Rep. of Germany

[21] Appl. No.: 820,867

[22] Filed: Jan. 21, 1986

[30] Foreign Application Priority Data

Jan. 24, 1985 [DE] Fed. Rep. of Germany ... 8501716[U]

[51] Int. Cl.[4] ..... B65D 81/22; B65D 69/00

[52] U.S. Cl. ..... 206/229; 206/303; 206/564; 206/581; 132/79 F

[58] Field of Search ..... 206/229, 226, 303, 563, 206/581, 564, 15.2; D3/30.5, 39; 132/79 A, 79 F, 81, 82 F, 83 B, 84 B

[56] References Cited

U.S. PATENT DOCUMENTS

| | | | |
|---|---|---|---|
| D. 159,900 | 8/1950 | Gessler | 206/564 |
| 2,201,035 | 5/1940 | Gordon-Stables | 132/82 F |
| 2,710,983 | 6/1955 | Abrams et al. | D3/30.5 |
| 2,826,347 | 3/1958 | Schiaro | 206/564 |
| 2,943,344 | 7/1960 | Reed | D3/30.5 |
| 3,015,120 | 2/1962 | Anderson | 206/229 |
| 3,131,410 | 5/1964 | Anderson et al. | 206/229 |
| 3,327,841 | 6/1967 | Schurman et al. | 206/564 |
| 3,724,654 | 4/1974 | Gerard et al. | 206/564 |
| 4,555,024 | 11/1985 | Voss et al. | 206/564 |
| 4,615,439 | 10/1986 | Weissenfels | 206/229 |

FOREIGN PATENT DOCUMENTS

| | | | |
|---|---|---|---|
| 768264 | 8/1934 | France | 132/82 F |
| 267225 | 6/1950 | Switzerland | 206/229 |

*Primary Examiner*—George E. Lowrance
*Assistant Examiner*—Brenda J. Ehrhardt
*Attorney, Agent, or Firm*—Martin A. Farber

[57] ABSTRACT

The present invention concerns a shoe-polish can with removable closure lid (2), integrated applicator (12) and shoe-polish containing space. In order to obtain a structural shape which is simple to manufacture and handle, the shoe-polish containing space be developed as an arcuate trough (3).

15 Claims, 12 Drawing Figures

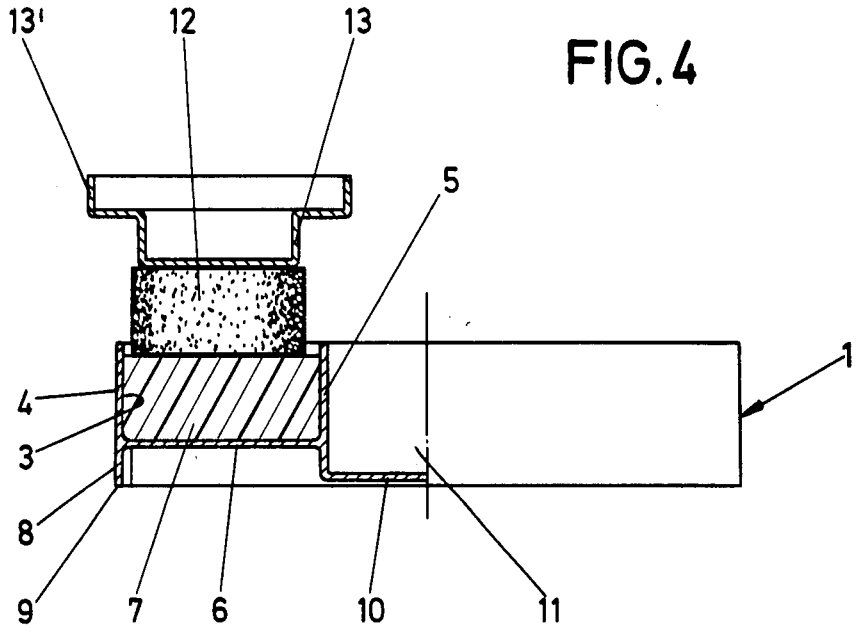
FIG. 4
FIG. 5
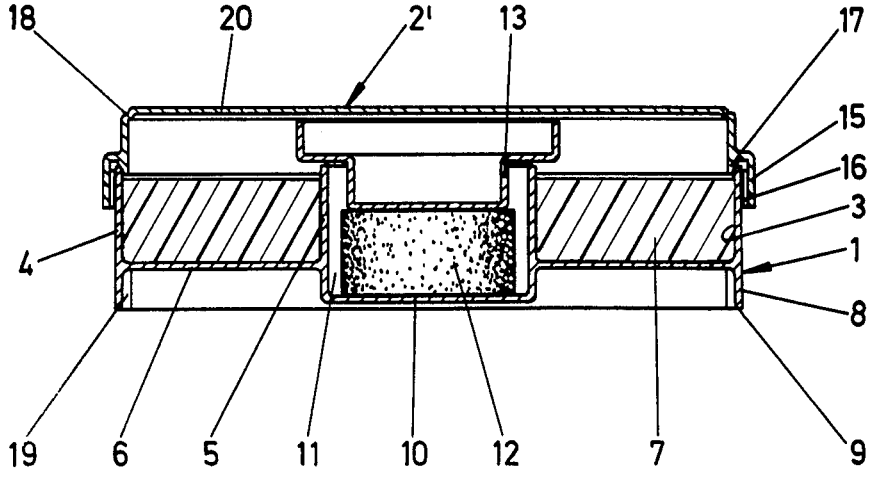

SHOE POLISH CAN

FIELD AND BACKGROUND OF THE INVENTION

The present invention relates to a can for shoe polish and similar paste material. The can having removable closure lid, integrated applicator and shoe-polish containing space.

Such an embodiment is known from Federal Republic of Germany Utility Model No. 83 24 492, in which the shoe-polish containing space has an elongated contour.

The object of the present invention is to increase the usefulness of a shoe-polish can of this type so as to obtain advantages in handling in the removal of the shoe polish.

SUMMARY OF THE INVENTION

This is achieved by constructing the shoe-polish containing space in the form of an arcuate trough.

As a result of this development, the shoe-polish can has increased utilitarian value. During removal of the shoe polish, the direction of removal movement is necessarily in the direction of the arcuate trough. One therefore substantially avoids the situation wherein shoe polish is pushed out of the shoe-polish containing space inadvertently by the applicator. Furthermore, the path of removal can, as a rule, be longer. This is advantageous, particularly if the shoe-polish containing space is almost empty and the remaining shoe polish is to be removed.

One further advantageous development resides in forming the arcuate trough with an annular shape. The removal can then be effected in circular direction, and is not impeded by transverse walls.

A favorable arrangement of the applicator is obtained by placing it in the center of the arcuate trough. The center of the arcuate trough, which is present in any event is therefore utilized.

A variant in the foregoing inventive feature is attained by extending the centrally arranged chamber into a radially directed channel within which the gripping handle of the applicator can be placed.

Another advantageous embodiment of the invention is attained by consists in the fact configuring the central chamber and the arcuate trough in oval form.

Still another advantageous development is attained by providing the ovally shaped arcuate trough, on the arcuate wall thereof along the smaller radius of curvature, with an additional housing which extends in longitudinal direction and receives the applicator.

Advantages in storage are obtained by a construction wherein the lid is provided on its top with a central dome and the bottom surface of the arcuate trough is set back with respect to a stand collar which is directed downward from the side wall of the housing. Upon the stacking of shoe-polsh cans, the dome can then fit in the space formed by the stand collar and rest against the bottom surface of the arcuate trough. In this way, a form-locked stacking is obtained so that a stack of the shoe-polish cans is imparted with great stability.

In this connection it is advantageous for the standing edge of the stand collar to lie in a plane which is flush with the bottom of the central chamber which receives the applicator. In this way, a chamber of large height can be produced in order to receive a correspondingly large applicator, which results in advantages in use.

It is furthermore advantageous for the diameter of the central chamber and the width of the arcuate trough to be of about the same size.

Furthermore, it is advantageous upon the stacking of such shoe-polish cans for the lid to form a rim bead which is concentric to the dome. The ring beads of adjacent shoe-polish cans rest against each other upon stacking.

Good utilization of the space is obtained in the manner that the handle for the applicator extends into the inside of the dome. The dome, which is used for the stacking of identical shoe-polish cans, therefore fulfills a further purpose in that it also receives a part of the handle of the applicator.

In order to obtain a substantially uniform removal of the shoe polish, the width of the applicator is substantially equal to the width of the curved trough.

Finally, an advantage is provided as in an embodiment which has a channel, and wherein end walls of the arcuate trough face the channel and are arched to mate with a curved surface of the applicator which is adapted thereto. In this way, complete emptying of the shoe-polish containing space is assured even in the region of the end walls.

BRIEF DESCRIPTION OF THE DRAWINGS

Seven embodiments will be explained below with reference to FIGS. 1 to 12 of the drawing, in which;

FIG. 4 shows, partly in front view and partly in cross section, the shoe-polish can with the applicator in position of use;

FIG. 5 is a cross section through the shoe-polish can according to the second embodiment which has a modified closure lid as compared with the first embodiment;

DETAILED DESCRIPTION OF THE PREFERRED EMBODIMENTS

Figure 1:
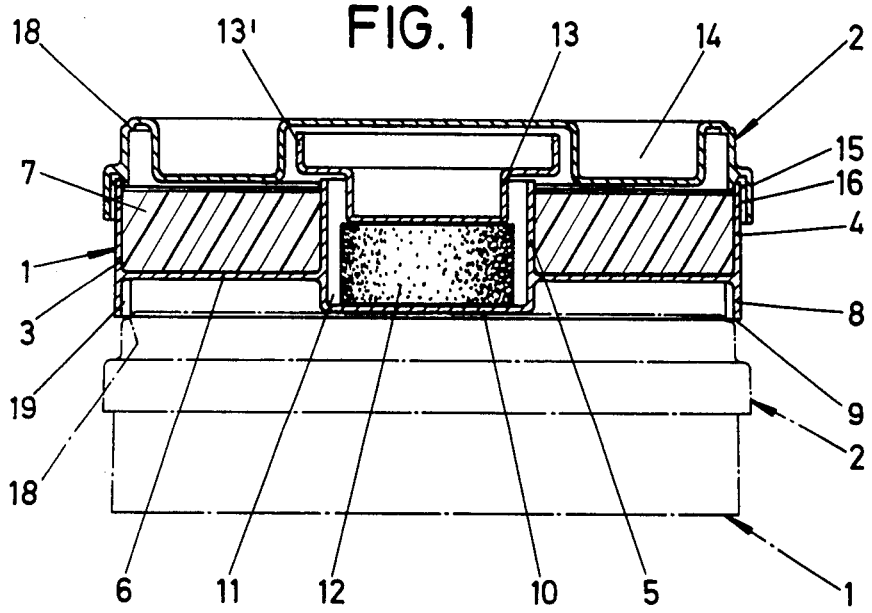
FIG. 1 is a cross section through the shoe-polish can according to the first embodiment, with the closure lid attached.
Figure 2:
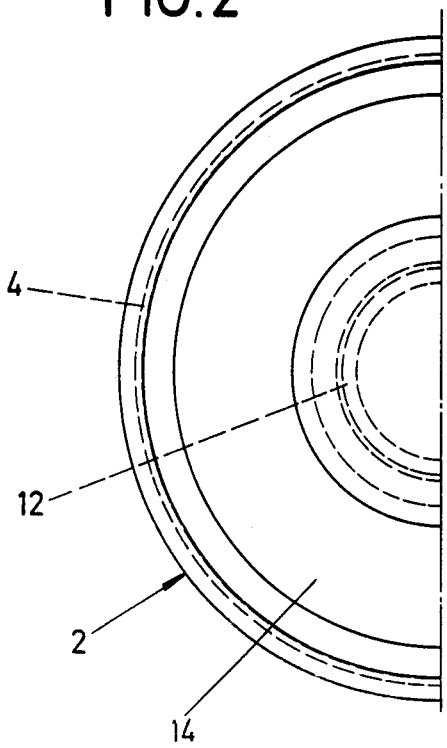
FIG. 2 is a top view of the shoe-polish can.
Figure 3:
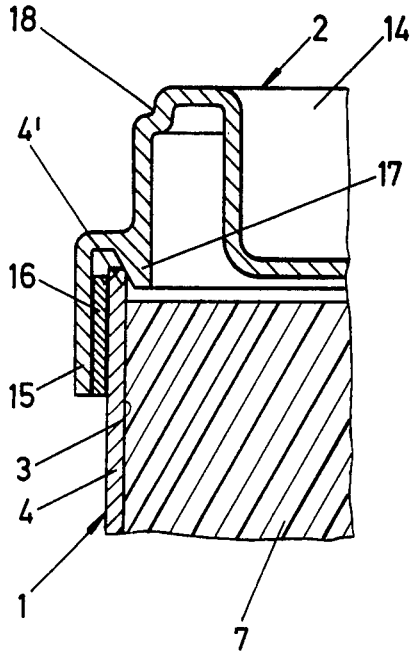
FIG. 3 shows a portion of the edge of the shoe-polish can, shown on a larger scale.

The shoe-polish can shown in FIGS. 1 to 4 has a circular contour and is formed of a housing 1 and a closure lid 2 which grips over the latter. Specifically, the housing 1 has an arcuate trough 3 which is closed in ring shape. It is defined by the cylindrical side wall 4 of the housing 1, by the inner wall 5 which extends concentrically to the latter and by a trough bottom surface 6. The arcuate trough 3 is the shoe-polish containing space and contains the paste-like shoe polish 7.

The side wall 4 is continued beyond the bottom surface 6 of the arcuate trough by a stand collar 8. This stand collar 8 terminates in a slip 9 which lies approximately in a plane flush with the bottom 10 of the central chamber 11 formed by the inner wall 5. This chamber serves to receive an applicator 12. The width or diameter of this applicator corresponds to the width of the arcuate trough 3. The applicator 12 is developed as a small sponge borne by a handle 13. The handle sits on the facing end surface of the applicator 12. The handle 13, which is approximately of cup shape, passes beyond the upper edge of the housing 1 into a section 13' of larger cross section which extends into the closure lid 2. Concentric to the section 13', the closure lid 2 is provided with an annular indentation 14. This indentation passes into a lid rim 15 which grips over the upper edge of the side wall 4. In order to obtain a good seal, the lid rim 15 is provided on the inside with a sealing ring 16. Furthermore, in the region of the upper edge 4', of the side wall 4 the lid rim forms a sealing cone 17 which comes against an edge 4'. In this way drying out of the shoe polish 7 is counteracted.

On the upper edge of the rim the closure lid 2 is provided with a step 18 into which strips 19, located on the inside of the housing in the region of the stand collar 8, enter upon stacking.

Shoe polish is removed in the manner that, first of all, the closure lid 2 is removed. Using the handle 13, the applicator 12 can be brought into the position of removal shown in FIG. 4.

In the second embodiment, shown in FIG. 5, the construction of the housing 1 corresponds to that of the first embodiment. The applicator 12 is also of equivalent development. Only the closure lid 2' has been modified. it lacks the foregoing indentation. Instead of this indentation, the surface 20 of the closure lid extends in a plane. Therefore, in this embodiment the parts are provided with the same reference numbers as the corresponding parts of the previous embodiment.

Figure 6:
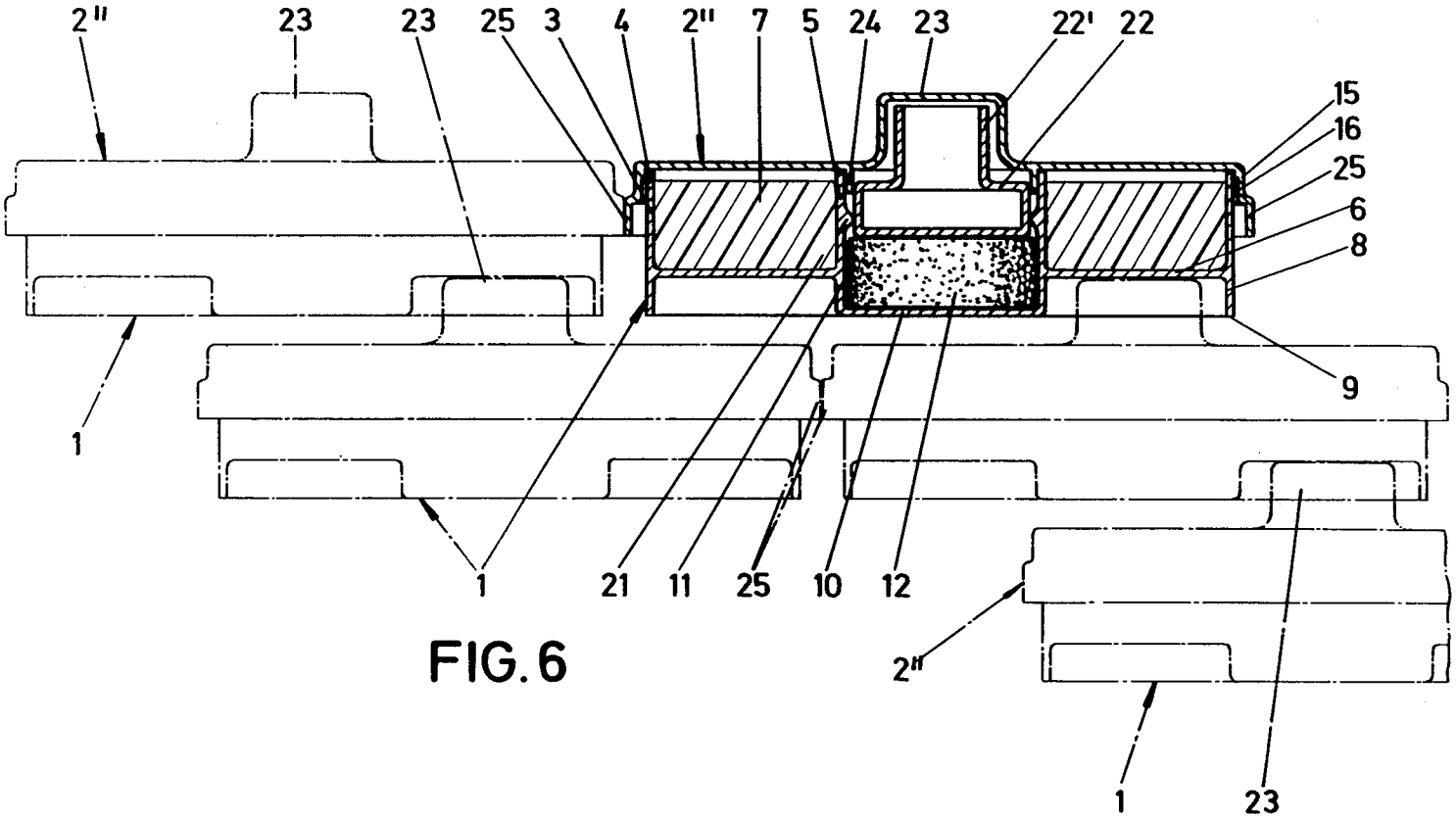
FIG. 6 is a cross section through the shoe-polish can of the third embodiment which can be stacked as shown by the dash-dot line.

In the third embodiment, shown in FIG. 6, the housing 1 also corresponds substantially to the housings mentioned above. The corresponding parts have accordingly been provided with the same reference numbers. One difference in the housing 1 is that the inner wall 5 is provided with an annular bead 21 which extends into the chamber 11 and comes against the facing outer wall of a handle 22 of the applicator 12. The handle 22 passes on one side into a stepped section 22' which extends into a central dome 23 on the top of closure lid 2". On the side of the lid 2 opposite the dome 23, there is provided a sealing collar 24 extending concentric to the dome 23. Collar 24 comes against the upper edge of the inner wall 5. In this way, the applicator 22 is closed off from the outer air and cannot dry out. It therefore remains flexible over its entire period of use and facilitates the application of the shoe polish.

Adjoining the rim 15 the closure lid 2" forms an edge bead 25. Upon the stacking of such shoe-polish cans the edge beads of adjacent shoe-polish cans come against each other. Upon such stacking the domes 23 of the shoe-polish cans come into the space under the bottom surface 6 of the arcuate trough and rest against the latter since they have a smaller diameter than the width of the arcuate trough 3. In this embodiment also, the diameter of the chamber 11 corresponds approximately to the width of the arcuate trough. This means that the diameter of the chamber 11 constitutes one-third of the diameter of the shoe-polish can.

Figure 7:
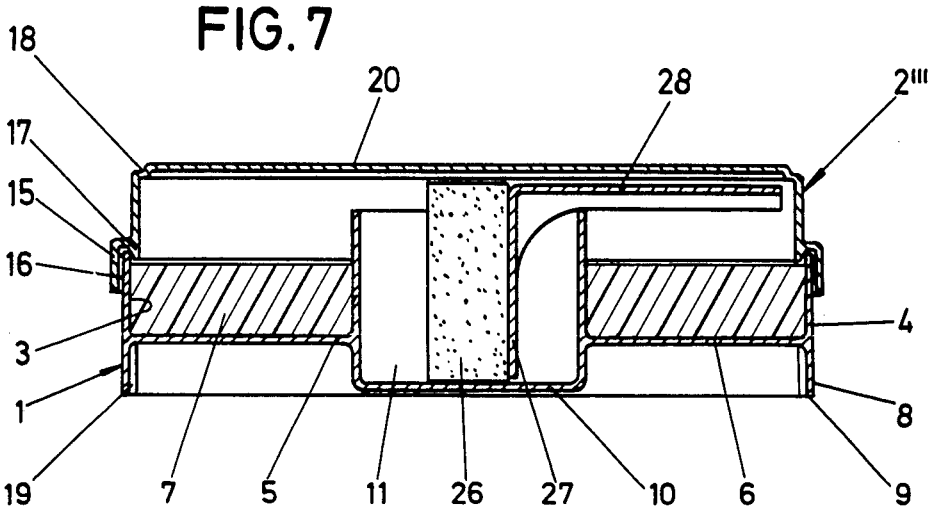
FIG. 7 is a cross section through the shoe-polish can according to the fourth embodiment.
Figure 8:
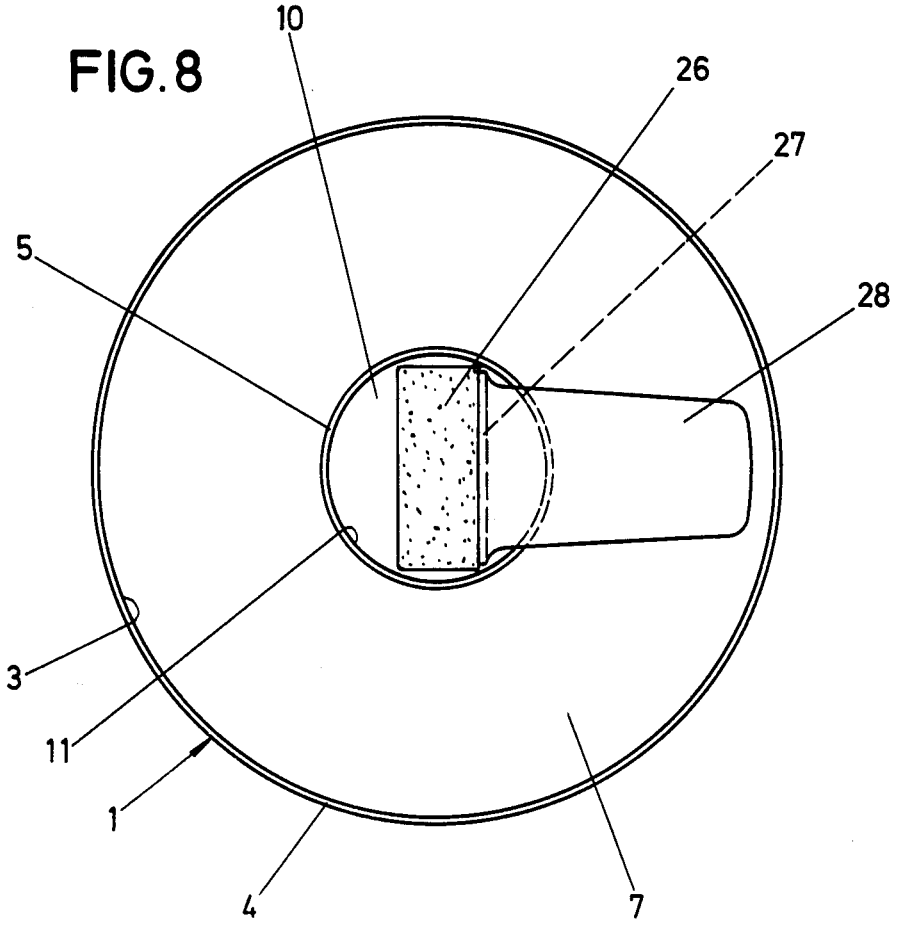
FIG. 8 is a top view of this shoe-polish can with the closure lid removed.

The embodiment shown in FIGS. 7 and 8, constituting the fourth embodiment, also has a housing 1 of corresponding shape. In this case also, the same parts bear the same reference numbers. The inner wall 5 in this embodiment extends above the upper edge of the side wall 4. An applicator 26 extends into the chamber 11, which is of increased height. The applicator is borne by a 90° bent arm 27 of a handle 28 the lower edge of which rests on the upper edge of the inner wall 5 and extends radially. The closure lid 2''' corresponds in construction to the closure lid shown in FIG. 5.

Figure 9:
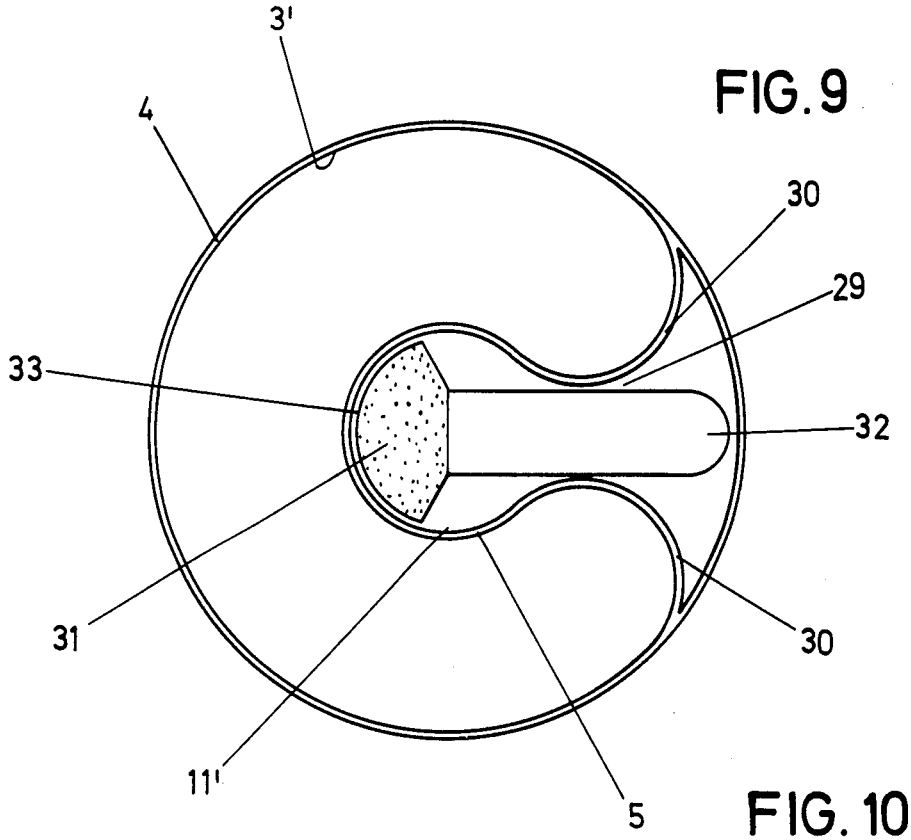
FIG. 9 is a top view of the shoe-polish can of the fifth embodiment, also with the closure lid removed.

In the fifth embodiment of the shoe-polish can, shown in FIG. 9, the central chamber 11' passes into a radially directed channel 29. End walls 30, which face the channel 29, are curved and extend into the side wall 4 and the inner wall 5. Accordingly, in this embodiment the arcuate trough 3' does not extend over an angle of 360°. The applicator 31 lies within the chamber 11'. It is fastened to a grasping handle 32 which extends through the channel 29 up to approximately the inner boundary of the outer side wall 4. The width of the handle 32 corresponds approximately to the inside width of the channel 29. The applicator 31 is developed in such a manner that its outer surface 33 is adapted in shape to the curvature of the end walls 30.

Figure 10:
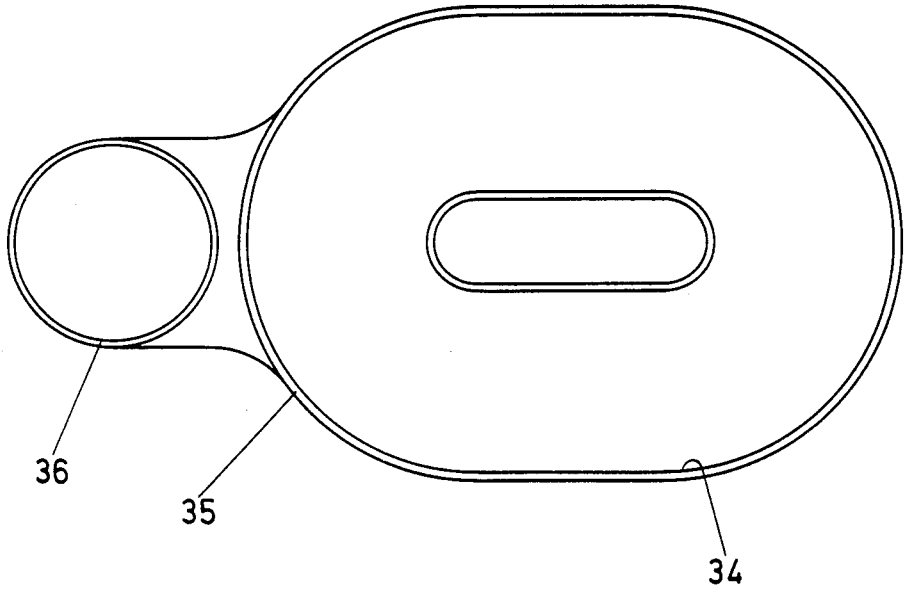
FIG. 10 is a top view of the shoe-polish can of the sixth embodiment, with the closure lid removed.

The sixth embodiment of the shoe-polish can, shown in FIG. 10, has an oval arcuate trough 34. An arcuate wall 35 has a smaller radius of curvature than the radius of the side of the can (which radius of curvature may be infinite as in the case of a straight side shown in FIG. 10) and supports a longitudinally extending additional housing 36 which represents the chamber for the receiving of an applicator, not shown.

Figure 11:
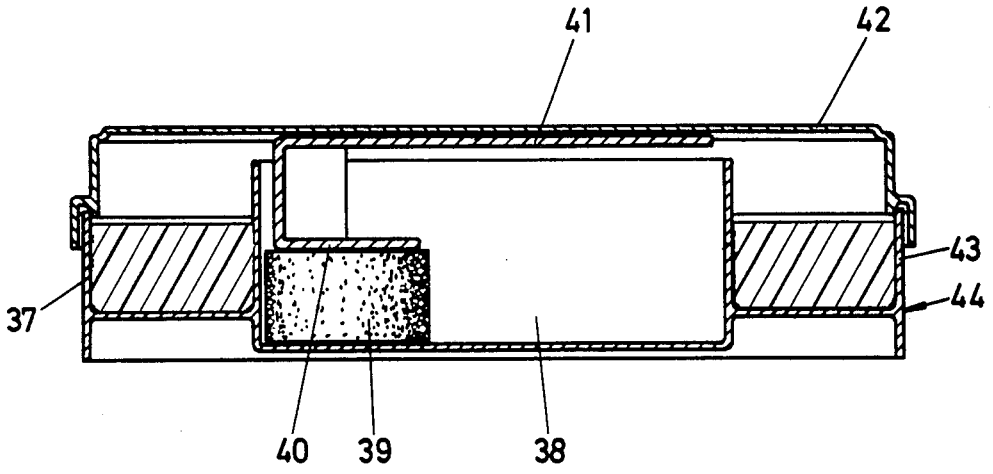
FIG. 11 is a cross section through the shoe-polish can of the seventh embodiment.
Figure 12:
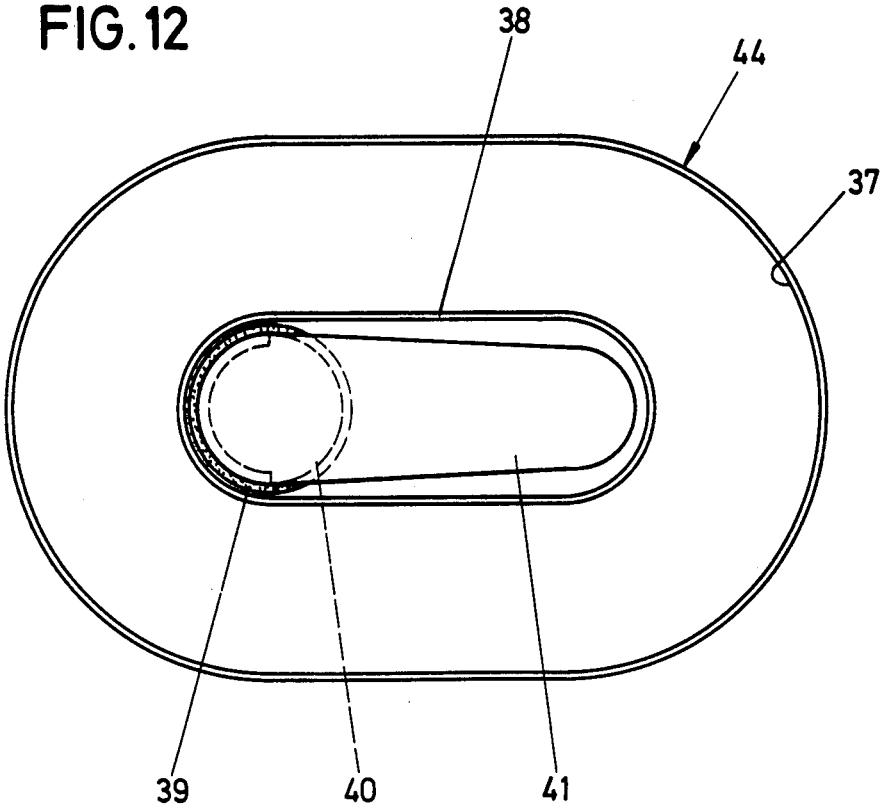
FIG. 12 is a top view of this shoe-polish can, the closure lid not being shown.

In the seventh embodiment of the shoe-polish can, shown in FIGS. 11 and 12, the arcuate trough 37 is also of oval shape. An applicator 39 lies within the central, also elongated, chamber 38 created therefore. The applicator is seated on an angularly bent arm 40 of a handle 41 which extends up to the bottom of an oval closure lid 42. The latter grips over the upper edge of the side wall 43 of the housing 44. The diameter of the applicator 39 corresponds approxiamtely to the width of the arcuate trough 37. The sealing of the lid is comparable to that of the embodiments described above. Stacking of the shoe-polish cans is possible also with this version.

It is to be understood that, while the foregoing description has been directed towards the storage and application of shoe polish, the invention applies equally well to other paste like materials and applicator therefore. The foregoing embodiments are illustrative of the principles of the invention, and modifications of these embodiments may occur to those skilled in the art. Accordingly, the invention is not to be regarded as limited to the embodiments disclosed herein, but is to be limited only as defined by the appended claims.

I claim:

1. A can for storage of shoe polish and similar paste materials, the can comprising a housing having a bottom and a removable closure lid disposed opposite said bottom, and being configured for retention of an integrated applicator having an applicator handle, an outer wall and an inner wall upstanding from said bottom and defining a paste containing space; and wherein said paste containing space is formed as an arcuate trough, said outer wall extends to meet said lid for closing off said paste containing space, said inner wall having an arcuate form to enclose a space for containing a head of the applicator, and said inner wall extends partway towards said lid to define a region for passage of said applicator handle from said head-containing space to said paste containing space and between said paste-containing space and said lid.

2. A can according to claim 1, wherein said arcuate trough has a ring shape, and the configuration of the can permits the applicator handle to extend beneath said closure lid without attachment thereto.

3. A can according to claim 2, further comprising a stand collar which is directed downward from a side wall of said housing; and wherein said closure lid is provided on its top with a central dome, and wherein a bottom surface of the arcuate trough is arranged set back with respect to said stand collar.

4. A can according to claim 1 wherein said arcuate trough encircles said head containing space to provide the can with a central chamber for receiving said applicator, and the configuration of said can and said closure lid permits the applicator handle to extend into the closure lid while protruding over said inner wall on one side thereof to overlap a part of said trough.

5. A can according to claim 4, wherein the configuration of said trough defines a centrally arranged chamber having a portion thereof which extends as a radially-directed channel configured for enveloping a grasping handle of said applicator, thereby to provide space in said can for containing said handle.

6. A can according to claim 4, wherein the central chamber and the arcuate trough are oval.

7. A can according to claim 1, further comprising a stand collar which is directed downward from a side wall of said housing; and wherein said closure lid is provided on its top with a central dome, and wherein a bottom surface of the arcuate trough is arranged set back with respect to said stand collar.

8. A can according to claim 7, wherein a lip of the stand collar lies in a plane flush with the bottom of a central chamber of said housing, said chamber being configured for receiving the applicator.

9. A can according to claim 8, wherein said collar and said outer wall define an arcuate channel, the diameter of the central chamber and the width of the arcuate channel being approximately the same.

10. A can according to claim 7, wherein the closure lid includes a rim bead which extends concentricly to the dome.

11. A can according to claim 7, wherein said applicator includes a handle which extends into the inside of the dome.

12. A can according to claim 1, wherein the width of the applicator is substantially equal to the width of the arcuate trough.

13. A can according to claim 1, wherein the can is a shoe-polish can.

14. A can for storage of shoe polish and similar paste materials, the can comprising a housing having a bottom and a removable closure lid disposed opposite said bottom, and being configured for retention of an integrated applicator having an applicator handle, an outer wall and an inner wall upstanding from said bottom and defining a paste containing space; and wherein said paste containing space is formed as an arcuate trough, said outer wall extends to meet said lid, wherein said trough is formed as an oval arcuate trough, said outer wall bounds the oval arcuate trough and is an arcuate wall which extends along the smallest radius of curvature of the oval, there being an additional housing which protrudes from said arcuate wall along a longitudinal axis of an oval of the trough for containing the applicator.

15. A can for storage of shoe polish and similar paste materials, the can comprising a housing having a bottom and a removable closure lid disposed opposite said bottom, and being configured for retention of an integrated applicator having an applicator handle, an outer wall and an inner wall upstanding from said bottom and defining a paste containing space; and wherein said paste containing space is formed as an arcuate trough, said outer wall extends to meet said lid, wherein said inner wall meets said outer wall to form two end walls of the arcuate trough which define a channel, the end walls facing the channel and being curved, and wherein the applicator has a surface which is curved to fit the channel.

* * * * *